United States Patent [19]

Onoyama et al.

[11] Patent Number: 4,705,656

[45] Date of Patent: Nov. 10, 1987

[54] METHOD FOR PRODUCING SPHERICAL METAL PARTICLES

[75] Inventors: Takashi Onoyama, Yokohama; Hiroshi Makino, Kawasaki, both of Japan

[73] Assignee: Nippon Yakin Kogyo Co., Ltd., Tokyo, Japan

[21] Appl. No.: 882,078

[22] Filed: Jul. 3, 1986

Related U.S. Application Data

[62] Division of Ser. No. 698,558, Feb. 6, 1985, abandoned.

[30] Foreign Application Priority Data

Feb. 10, 1984 [JP] Japan ..... 59-24180

[51] Int. Cl.[4] ..... B22F 9/10

[52] U.S. Cl. ..... 264/8; 75/0.5 C; 264/15; 425/8

[58] Field of Search ..... 264/5, 8, 15, 164, 309; 425/6, 8; 65/8, 12, 15; 75/0.5 C

[56] References Cited

U.S. PATENT DOCUMENTS

| | | | |
|---|---|---|---|
| 2,213,365 | 9/1940 | Hiller | 425/8 |
| 3,649,233 | 3/1972 | Battigelli | 425/8 |
| 3,854,850 | 12/1974 | Ueda et al. | 425/8 |
| 3,904,344 | 9/1975 | Maringer et al. | 425/8 |
| 4,215,084 | 7/1980 | Maringer | 425/8 |
| 4,242,069 | 12/1980 | Maringer | 425/8 |
| 4,385,013 | 5/1983 | Couling et al. | 425/8 |
| 4,397,623 | 8/1983 | Porter et al. | 425/8 |

*Primary Examiner*—Jay H. Woo
*Assistant Examiner*—J. Fortenberry
*Attorney, Agent, or Firm*—Arnold S. Weintraub

[57] ABSTRACT

A method for producing spherical metal particle uses a molten metal reservoir for containing a molten metal, a rotary drum having a number of teeth onto which the molten metal is to be adhered one after another and a driving means for rotating the rotary drum so that the molten metal adhered to each of the teeth can be scattered from the teeth before even a part of each molten metal adhered to the teeth solidifies. At least one tooth of the rotary drum is dipped into the molten metal contained in the molten metal reservoir. The molten metal adhered to the teeth is scattered from the teeth before any portion of it has solidified by means of centrifugal force acting on the rotary drum. The molten metal assumes a spherical or similar shape during its trajectory due to surface tension. It cools by atmospheric cooling to solidify as discrete metal particles of substantially uniform diameter. The diameter of the solidified metal spheres can be predetermined by the uniform amount of the molten metal adherent on each tooth due to the uniform surface area of each of the teeth.

8 Claims, 7 Drawing Figures

(a)

(b)

(a)

(b)

METHOD FOR PRODUCING SPHERICAL METAL PARTICLES

This application is a division of application Ser. No. 698,558, filed 2/6/85 now abandoned.

BACKGROUND OF THE INVENTION

1. Field of the Invention

This invention relates to a method of producing metal particles of spherical shape or a shape closely similar to a sphere, more particularly, the present invention aims to produce large amount of spherical metal particles of relatively small and uniform diameter (0.1 to 3.0 mm) by using an apparatus of simplified construction.

2. Prior Art

Heretofore, there has been a method of making spherical metal particles as disclosed in Japanese Unexamined (Laid-Open) Patent Publication No. Sho 58 (1983)-52408. The publication discloses a method, in which the forward tip end of a metal bar is melted by heating while it is rotated at high speed of rotation, thereby a part of the molten metal is scattered to a surrounding atmosphere forming a number of droplets then each of thus scattered droplets of molten metal will solidify being cooled by the atmosphere while they also take spherical form due to surface tension, thereby a large number of metal particles of spherical shape or similar configuration are produced.

However, the size of the metal particles obtained by the aforesaid method is liable to be varied considerably.

There is also a method which appears similar to the present invention with respect to the technical concept of forming particles, that is, the method and apparatus for making flake-like particles disclosed by Japanese Unexamined (Laid-Open) Patent Publication No. Sho 54 (1979)-60262. However, such a method of making metal flakes according to the above-mentioned publication differs entirely from the technical concept of the present invention, because the disclosed method uses a heat extracting circular disc made of a material having high heat transfer coefficient and carrying thereon a large number of teeth or serrations, onto which molten material is adhered to form flake-like particles which are then solidified at least partly by removing their heat by the heat extracting circular disc, subsequently thus solidified flake particles leave from the serrations so as to be cooled into discrete flake particles.

3. Objects of the Invention

The inventor of the present invention intended to produce spherical metal particles by a method different from those methods of making metal particles mentioned above and has been accomplished by this invention.

An object of this invention is to provide a method of producing a large number of spherical metal particles of relatively small size in a continuous manner by making use of a property of a drop of molten metal which is apt to take the form of a sphere due to its surface tension and by relying on the steps of intermittently scattering a predetermined amount of molten metal into the surrounding atmosphere by a rotary drum, each scattered droplet of molten metal to solidify while being cooled by the atmosphere and to be sphere due to the surface tension of the droplet itself. Another object of the invention is to provide metal particles of uniform particle size.

4. Summary of the Invention

The present method utilises an apparatus for producing spherical metal particles comprising, a molten metal reservoir to contain a molten metal, a rotary drum carrying a plurality of teeth or serrations around its outer periphery on which the molten metal is to be adhered and a driving means for rotating the rotary drum at a speed that the molten metal adhered to each serration can successively be scattered by centrifugal force before even a part thereof solidifies.

In other words, the present invention produces metal particles of uniform diameter by successively dipping the tooth or serration disposed around the outer periphery of the drum into the molten metal contained in the reservoir, scattering the molten metal adhered to each tooth or serration one after another as a droplet, by the centrifugal force caused by the rotation of the drum, before even a part of the adhered metal solidifies, cooling the thus scattered molten metal by the atmosphere during its flight to solidify while allowing each droplet to become spherical or closely similar configuration having substantially uniform particle diameter.

According to the present invention, molten metal in the reservoir adheres to each of the teeth or serrations formed around the rotary drum, one after another, thus the amount of the molten metal which determines the diameter of the metal sphere when solidified can be decided by the uniform surface area of the serrations.

DETAILED DESCRIPTION OF THE PREFERRED EMBODIMENTS

Explanation will now be made on the embodiments by referring to the attached drawings.

FIGS. 1 to 6 are drawings showing an embodiment of the present invention.

Figure 1:
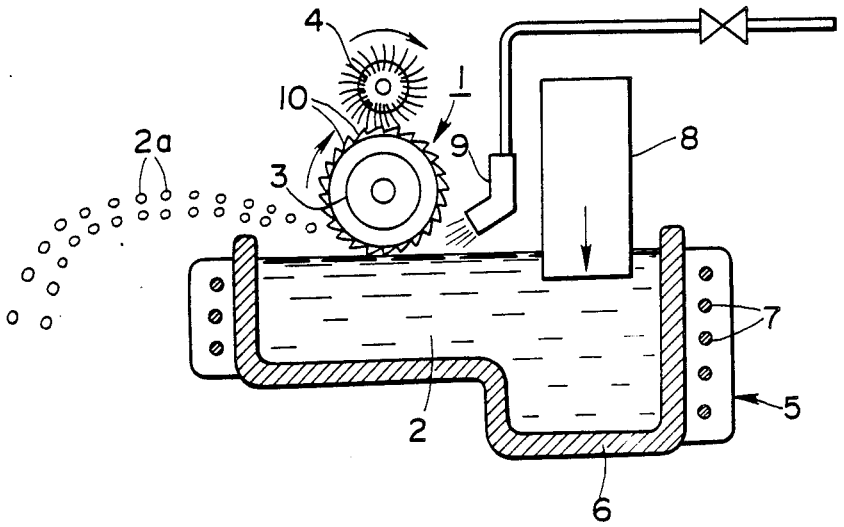
FIG. 1 is a diagrammatical drawing showing one example of the present invention.
Figure 4:
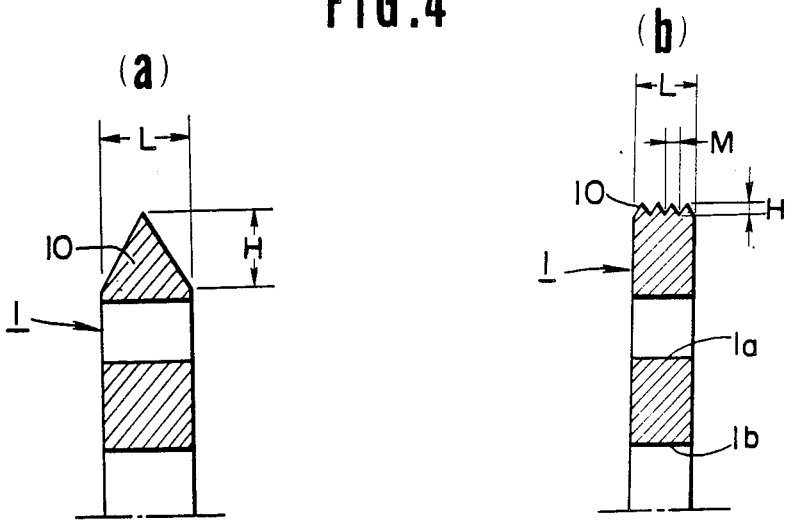

At first, the construction of the apparatus for carrying out the method of present invention will be explained, numeral 1 in FIG. 1 is a rotary drum of circular disc shape, around the outer periphery of which a large number of teeth or serrations 10 are provided, each of which is formed with a receiving surface 10*b*. *Unit serration 10 in FIG. 4(a)* is composed of a single tooth, while the unit serration 10 in FIG. 4(*b*) consists of four parallelly formed teeth.

Figure 2:
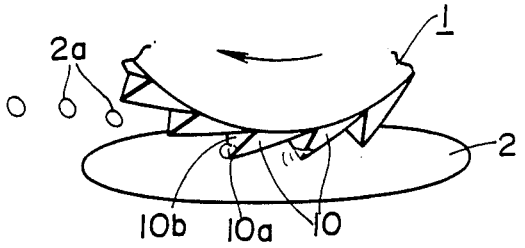
FIG. 2 is a perspective view showing the main part of FIG. 1.
Figure 3:
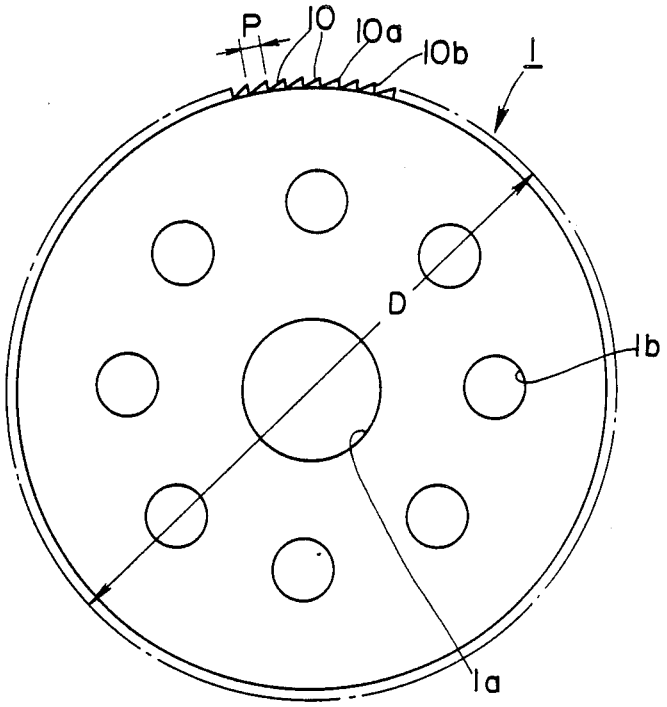
FIG. 3 is a front view of the rotary drum, FIGS. 4(*a*) and (*b*) are a sectioned half of the drum taken along the center line of FIG. 3, FIGS. 5(*a*)–(*e*) are illustrative side view showing the relation between the teeth or serrations and the molten metal, among which FIGS. (*a*)–(*c*) show teeth or serrations of different inclination angles with respect to the surface of the molten metal, FIG. 5(*d*) shows a drop of molten metal adhered on the receiving face of a serration and FIG. 5(*e*) shows a drop of molten metal adhered at the tip end of a serration, FIGS. 6(*a*) and (*b*) are plan views showing serrations formed on the rotary drum, wherein FIG. 6(*a*) shows serration in a single row and FIG. 6(*b*) shows serrations in four rows, FIGS. 7(*a*) and (*b*) are perspective views showing other embodiments of differently shaped teeth or serrations.

Shown in FIG. 2 is a serration in the shape of a spire of pyramidal cone, among the pointed top faces 10*a* of which the face facing toward the direction of rotation of the drum 1 constitutes a receiving face 10*b*, which forms an angle $\alpha$ relative to the surface of the molten metal 2, when the tooth 10 is at its nearest point thereto, selected within a range of 30° to 120°, particularly, the range of angle from 45° to 90° was found to be preferable to obtain most desirable results. The receiving faces 10*b* are of uniform size.

1*a* is a hole for inserting a shaft and 1*b* denotes holes for introducing cooling water. The rotary drum 1 is fabricated of material such as pure copper, stainless steel (for example, 18-8 stainless steel of Japanese Industrial Standard SUS-304 type) or the like.

The numeral 3 shown in FIG. 1 is a driving means for rotating the rotary drum 1 at high speed composed of, for instance, an electric motor, speed change means and the like, and is coupled to the rotary shaft of the rotary drum 1.

Rotational speed of the rotary drum 1 is selected to be such a rate that the molten metal adhering to the teeth or serrations 10 can be scattered away from the tip end 10*a* or the receiving face 10*b*, as shown in FIG. 2 and the like due to the centrifugal force imparted by the rotation of the rotary drum 10 before even a small part of the molten metal begins to solidify.

Moreover, the rotary drum 1 is constructed by using a suitable lifting means (not shown) so as to be lifted up or lowered down so that the drum 1 can be placed above the molten metal 2 when it is not operated, while it is lowered down in operation so that the tip end 10*a* of the serration 10 can be dipped into the bath of molten metal 2.

In the drawing, 4 is a wiper for wiping off the metal skin remaining attached on the tip end 10*a* or the receiving face 10*b* without being scattered therefrom by the centrifugal force imparted by the rotation of the rotary drum 1.

Disposed below the rotary drum 1 is a melting means 5, for receiving therein the molten metal 2, consisting of a molten metal reservoir 6 composed of refractory material such as graphite or alumina and structural member, and a heat generating element 7 disposed being wound around the molten metal reservoir 6 so as to heat and maintain the molten metal at a desired temperature.

Figure 5:
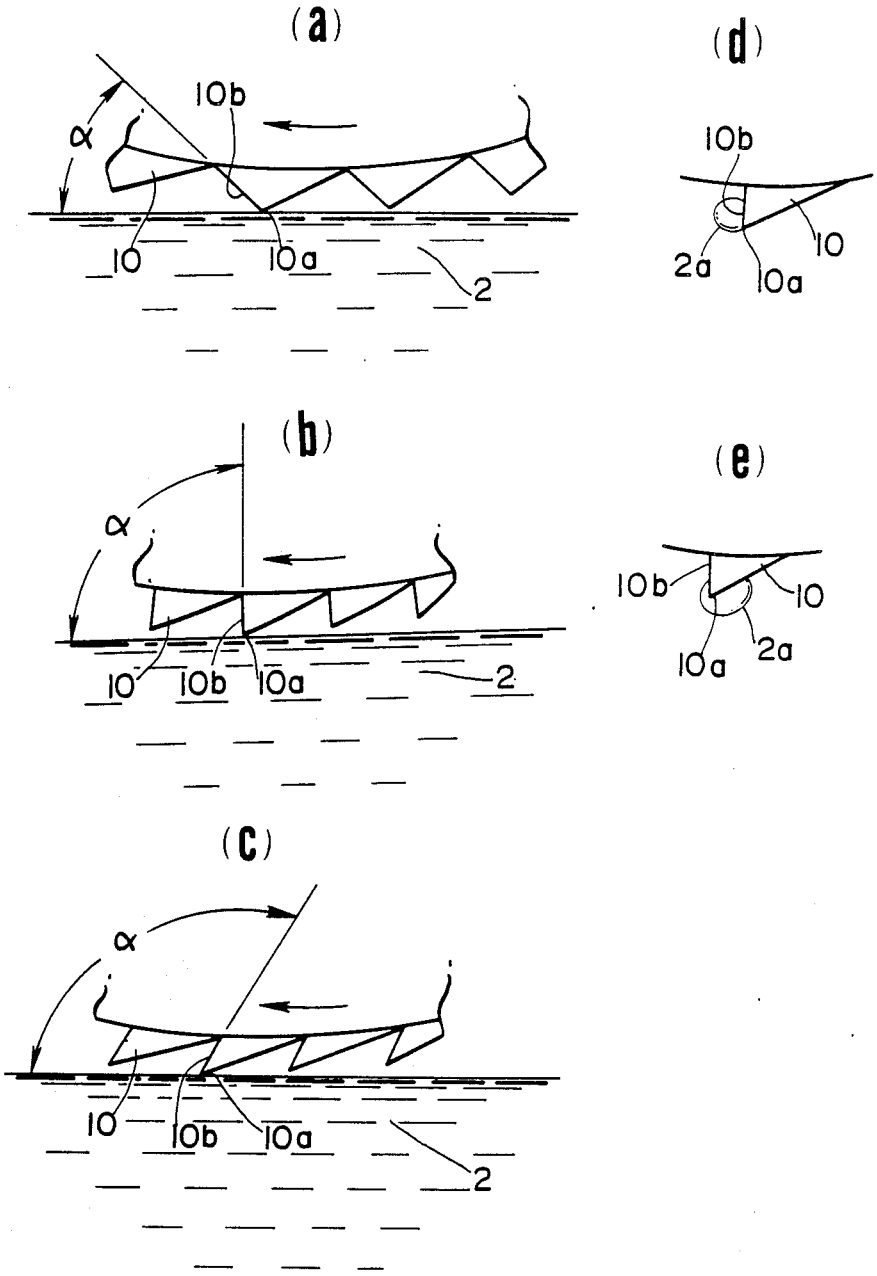

In this way, the molten metal 2 of desired uniform quantity is scooped up either by the receiving face 10*b* of the teeth 10 of the rotary drum 1, as shown by FIG. 5(*b*), or by the forward tip end 10*a* shown in FIG. 5(*c*), then each of the droplet 2*a* of desired quantity is scattered by the centrifugal force imparted by the rotation of the rotary drum 1 and solidifies during its flight by the surrounding atmosphere.

Figure 6:
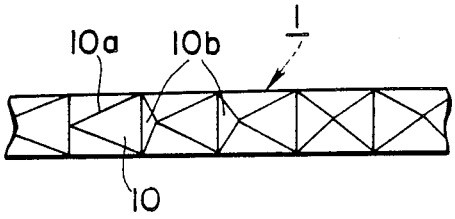
Figure 6:
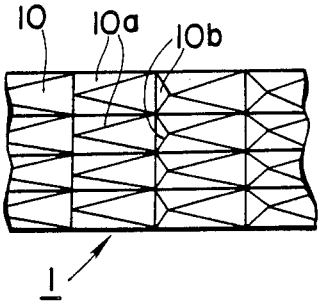

FIG. 6 is a plan view of the teeth or serrations 10 shown by FIG. 5.

Numeral 8 in FIG. 1 is a level block for adjusting the level of the surface of the molten metal 2 and is composed of a refractory material such as refractory bricks so as to maintain the level of the molten metal at a desired level by being moved up and down depend upon the production rate of the metal particles. Numeral 9 is a subsidiary heating means to heat the lower part of the rotary drum 1 and the molten metal 2 into which the lower part of the rotary drum 1 is inserted, and thereby prevents both the rotary drum 1 and the molten metal 2 from being cooled by the surrounding atmosphere.

As materials for producing metal particles, various materials such as stainless steel, tin and the like can be used.

Explanation will now be made on the carrying out of the method operation of the present invention.

At first, a suitable amount of molten metal 2 is stored in the molten metal reservoir 6 of the melting means 5. That is, molten metal such as stainless steel or the like melted by a melting furnace (not shown) is received in the molten metal reservoir 6, and at the same time, the reservoir 6 is heated by the heating element 7 to maintain the molten metal always at the same temperature. Also, at the same time, surface temperature of the molten metal 2 is maintained at a sufficiently high temperature by the subsidiary heating means 9 so that the air drawn up and blown to the surface of the molten metal 2 by the rotary drum 1 does not cause the surface temperature of the molten metal to drop. Such a temperature control of the molten metal 2 is performed by a suitable temperature controller, not shown, in an automatic manner.

Starting from this condition, the driving means 3 is started to rotate the rotary drum 1 at high speed. Then the lifting means is actuated to move the rotary drum 1 to dip the forward tip end 10*a* of the teeth 10 at the lower side of the rotary drum 1 into the molten metal 2. By this action, the molten metal 2 contacting the rotating teeth 10 is scooped up by the tip end 10*a* of the teeth 10 and the receiving face 10*b* formed by the forwardly facing face of the teeth 10, as the results, the molten metal 2 of desired amount corresponding to the area of the tip end portion 10*a* or the receiving face 10*b* is rotated together with respective tooth.

Since the peripheral speed of the rotary drum 1 is settled such that the droplet 2*a* adhered to the tip end portion 10*a* or the receiving face 10*b* can be scattered from the tooth before even a part of the drop solidifies, consequently, the molten droplet 2*a* adhered to the tip end portion 10*a* or to the receiving face 10*b* is scattered by the centrifugal force imparted by the rotation of the rotary drum 1, in the surrounding atmosphere.

As the molten metal droplet 2*a* in flight is sufficiently heated and that it remains unsolidified and tends to contract due to its own surface tension to take as small surface area as possible taking on a sphere or in sphere-like shape is formed the moment the droplet leaves the tip end portion 10*a* or the receiving surface 10*b*. All of the droplet 2*a* thus formed into spheres are of the same volume and are rapidly cooled by the surrounding atmosphere and solidify in the form of a sphere.

In this instance, it was found preferable that the angle formed between the receiving face 10*b* and the upper surface of the molten metal 2 lies within a range from 45° to 90° when the tooth 10 is at its nearest point to the surface of the molten metal. If the angle is an excessively large one or too small it will not produce metal particles of good spherical shape. It is considered that this cause can be attributable to the fact that too large an angle as well as too small an angle gives rise to too small amount of the molten metal adhering to the receiving surface 10*b* and rather, adhered metal is apt to widely spread over the receiving surface forming a thin layer.

It was also found that the range of the angle should be kept within a range of about 30 to 120 degrees. With angles below 30 degrees or above 120 degrees, the obtained particles were somewhat deformed as if they were flattened by pressing.

Next, explanation will be made on the result of tests according to the present invention.

The material and the dimension of the rotary drum 1 used for the tests are shown in the Table I below.

TABLE I

| | |
|---|---|
| Material | ① pure copper<br>② stainless steel |
| Diameter of Drum (D) | 200 mm |
| Width of Drum (L) | 18 mm |
| Number of Teeth in Raw | 4 |
| Bottom Width of Teeth (M) | 4.5 mm |
| Height of Teeth (H) | 3.0 mm |
| Pitch of Teeth (P) | 8.0 mm |
| Total Number of Teeth | 312 |

Particulars of test conditions are shown in Table II.

TABLE II

| Test Condition | Test Series | | |
|---|---|---|---|
| | Test No. 1 | Test No. 2 | Test No. 3 |
| Molten Metal Used | Tin (99.9% Sn) | Stainless Steel (SUS-444: 18 Cr—2 Mo—Fe) | Stainless Steel (SUS-430, 18 Cr—Fe) |
| Atmosphere | Air | Air | Air |
| Heating Temperature (°C.) | 280—300 | 1550—1600 | 1580—1620 |
| Material of the Drum | Copper | Copper | Stainless Steel |
| Rotation Speed (rpm) | 560 | 560 | 620 |
| Peripheral Speed (m/s) | 5.9 | 5.9 | 6.5 |
| Material applied to the Teeth | Sprayed $MoS_2$ | Not Applied | Not Applied |
| Subsidiary Heating Means | used | Used | Used |
| Material of Wiper | Brass Wire | Brass Wire | Brass Wire |

The results of the three tests were as follows:

(1) Through the Test No. 1 spheres of different diameter ranging from 0.2–1.0 mm and slightly deformed spherical particles were obtained.

(2) Through the Test No. 2 spheres of different diameter within a range of 0.3–1.5 mm and deformed sphere-like particles were obtained. Production rate of the metal particles was 35.1 kg/hour (yield of 80%). The weight of the metal particle having a diameter of 1.0 mm is about 0.0042 gram.

(3) Obtained particles through the Test No. 3 were spheres having different diameter ranging from 0.3 to 1.2 mm and deformed sphere-like particles and the diameter of the obtained particles, as a whole, was smaller than those obtained by the test No. 2, but the yield was proved to be over 90%.

As can be clearly seen from these test results, it was found that, by virtue of the present invention, metal particles of spherical shape or close to a sphere can be produced directly from molten metal continuously and in large quantities, and yet the construction of the apparatus can be made very simple.

It was also found by the embodiment of this invention that application of molybdenum sulfide, a parting agent for casting moulds (major part of which is fine powders of refractory material), rape-seed oil or the like to the teeth 10 would suppress the amount of heat removed from the drop of molten metal 2 by the tip end portion 10*a* or the receiving surface 10*b*, thereby could retard solidification of the adhered metal drop.

In the previously mentioned embodiments, droplets 2*a* of the molten metal 2 are scattered in the air so as to be cooled and solidified by the atmosphere, however, it is also possible, of course, to cool the droplets during their flight in an inert gas.

Figure 7:
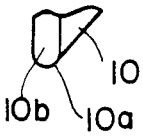
Figure 7:
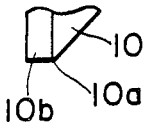

FIG. 7(*a*) and FIG. 7(*b*) show other configurations of the receiving face 10*b* of the teeth 10 disposed on the rotary drum 1 according to the other embodiments of the present invention. FIG. 7(*a*) shows a receiving face having a tip end of semi-circular shape, while FIG. 7(*b*) shows another one having straight front end.

It goes without saying that the number of teeth in a single circumferential array as well as the number of such arrays shall not be limited to that shown by the embodiments or examples described herein, but any suitable number of arrays and teeth can be selected depending upon conditions and demand.

What is claimed is:

1. A method of producing spherical metal particles comprising the steps of: dipping teeth or serrations disposed around the outer periphery of a rotary drum into molten metal contained in a molten metal reservoir by lowering the drum until a tip end of the teeth contacts the molten metal, scattering the molten metal adhered to the teeth away from said teeth by centrifugal force acting on said rotary drum before even a part of said molten metal adhered to said teeth solidifies, cooling said molten metal to solidify during its flight by a surrounding atmosphere while letting each of the scattered molten metal droplets take the shape of a sphere or similar configuration due to its own surface tension.

2. A method of producing spherical metal particles comprising the steps of:

providing a molten metal bath contained within a reservoir;

providing a drum including a row of uniform teeth disposed on an outer surface thereof and projecting angularly from a plane tangential to the drum, each tooth having a tip end;

heating the upper surface of the molten metal within the reservoir and a lower part of the rotary drum with an auxiliary heating means;

rotating the drum at a constant speed in a predetermined direction;

lowering the drum until the tip end of the teeth contact the molten metal;

scattering molten metal adhered to the teeth away from the teeth by means of centrifugal force generated by the rotating rotary drum before any of said metal has solidified;

allowing the scattered molten metal to form molten droplets of spherical shape due to surface tension of the molten metal; and allowing the spherical molten droplets to solidify by atmospheric cooling, thereby forming spherical, solid metal particles.

3. The method of claim 2 wherein the molten metal adheres to a tip portion of each tooth.

4. The method of claim 2 further comprising the step of applying a releasing agent to the row of teeth.

5. The method of claim 4 wherein the releasing agent comprises rape seed oil.

6. The method of claim 4 wherein the releasing agent comprises molybdenum sulfide.

7. The method of claim 2 further comprising the step of providing each of the teeth with a receiving face which faces toward the direction of rotation of the drum, the angle between the receiving face and the surface of the molten metal when the tooth is at its nearest point thereto being in a range of from 30° to 120°.

8. The method of claim 2 further comprising the step of providing each of the teeth with a receiving face which faces toward the direction of rotation of the drum, the angle between the receiving face and the surface of the molten metal when the tooth is at its nearest point thereto being in a range of from 45° to 90°.

* * * * *